United States Patent [19]

Brick

[11] Patent Number: 4,498,579

[45] Date of Patent: Feb. 12, 1985

[54] COMBINATION TOWEL AND RAIN COVER FOR A GOLF BAG

[76] Inventor: Jack Brick, 10800 N. Military Trail, Palm Beach Gardens, Fla. 33410

[21] Appl. No.: 624,721

[22] Filed: Jun. 25, 1984

[51] Int. Cl.[3] ..... A63B 55/00; A63B 57/00

[52] U.S. Cl. ..... 206/315.4; 150/52 G

[58] Field of Search ..... 150/52 G; 206/315.2, 206/315.3, 315.4

[56] References Cited

U.S. PATENT DOCUMENTS

| | | | |
|---|---|---|---|
| 1,700,734 | 2/1929 | Brandt | 206/315.3 |
| 2,014,589 | 9/1935 | Saad | 206/315.4 |
| 2,115,307 | 4/1938 | Kneeter | 206/315.4 X |
| 2,552,501 | 5/1951 | Wilkens | 206/315.4 |
| 2,704,563 | 3/1955 | Henrich | 206/315.4 X |
| 3,128,812 | 4/1964 | Scheurer | 206/315.4 |
| 3,406,419 | 10/1968 | Young | 150/52 G X |
| 3,938,570 | 2/1976 | Stewart | 150/52 G |
| 3,977,451 | 8/1976 | Duba | 206/315.4 |
| 4,249,586 | 2/1981 | Setani | 206/315.4 |
| 4,368,768 | 1/1983 | Cunko, Jr. | 206/315.4 X |

FOREIGN PATENT DOCUMENTS

| | | | |
|---|---|---|---|
| 6126 | of 1911 | United Kingdom | 206/315.3 |

*Primary Examiner*—William Price
*Assistant Examiner*—Sue A. Weaver
*Attorney, Agent, or Firm*—Eugene F. Malin

[57] ABSTRACT

There is disclosed herein a golf bag cover having a waterproof outer surface and a towel like inner surface. The cover may be attached to the shoulder strap buckle of a golf bag and reversed to serve as a towel attached to the bag. When weather requires, the cover may be reversed and placed over the top of the bag to protect the clubs and interior of the bag from the rain.

13 Claims, 6 Drawing Figures

COMBINATION TOWEL AND RAIN COVER FOR A GOLF BAG

This invention relates to a golf bag cover and more particularly to such a cover which is reversible to serve the dual function of a towel.

As any golfer knows, it is important to have many items besides golf clubs and golf balls with him when going out on the golf course. For example, it is desirable to have a hand towel readily available which the golfer can use to wipe his hands, his clubs or golf balls prior to swinging a club. This is particularly true on very hot days when the palms of the golfer's hands may tend to perspire as well as during the early morning when the dew on the grass will cause the golfer's clubs and golf balls to be wet. In addition, a necessary item which the golfer wants to have is a golf bag cover so that the clubs can be protected from the rain in the event that it begins raining during the middle of a round.

Typically both the towel and the cover, are available as individual items and the golfer carries them in the various pockets of the golf bag. However, these items must share the limited space in the golf bag pockets with the many other things such as balls, tees, score cards, pencils, gloves and the like which the golfer also carries. To find either of the items requires digging through the bag and causing the smaller items to fall to the bottom. It is common that the towel, which is used during most rounds of golf, will be placed on top of the clubs during play and can easily be lost. If the towel is replaced in the bag pockets it not only is inconvenient but also prevents the towel from being dried out by the sun. This invention provides great convenience not presently available to the golfer.

It is also common to have a protective hood to fit over the bag in case of rain. The hood may typically be attached to the shoulder strap or its buckle and be rotated over the top of the bag to cover the clubs. However, golfers will typically unattach the hood because it is hopefully seldom used and put it within one of the pockets of the golf bag. When a rain storm does occur, the golfer then must rummage through the various pockets in his golf bag and try and find the bag cover.

Golf bag covers, which attach to the sides of a golf bag, are well known in the prior art. For instance, in U.S. Pat. No. 2,704,563 a cover which attaches to the shoulder strap is shown. In U.S. Pat. No. 1,915,889 a golf bag cover which fits inside the bag is shown and includes a zipper for allowing the cover to come apart for storage within the bag. Also in U.S. Pat. No. 1,700,734 a golf bag cover is shown. Lastly, another type of cover is shown in U.S. Pat. No. 2,985,212. However, none of these covers can serve the dual purpose of both a bag cover and a towel.

It would be preferable to have a combination of a towel and a bag cover which attaches to the bag and which is available as a towel for the golfer's easy use and, when required, which is readily available as a cover to be placed over the top of the bag. Such a combination towel and cover has the advantage that the golfer can readily reach for the towel as often as desired during a round of play and upon the occurence of a rain shower can quickly utilize the reversible side as a waterproof cover. To properly function as a cover, however, the combination must contain a water repellant side so that it does not quickly become soaked and allow water to drip into the club compartments.

In accordance with one aspect of this invention, there is provided a golf bag cover for being attached to a golf bag comprising a reversible hood having inner and outer surfaces. The inner surface is a towel material and the outer surface is a water repellant material. In addition the bag comprises means for attaching the hood to the shoulder strap area of the golf bag and means for fastening the hood over the golf bag with the outer surface being exposed. The hood is reversed when not fastened over the golf bag so that the exposed inner surface serves as a towel hanging from the strap area.

One preferred embodiment of the subject invention is hereafter described with reference being made to the following figures, in which.

Figure 1:
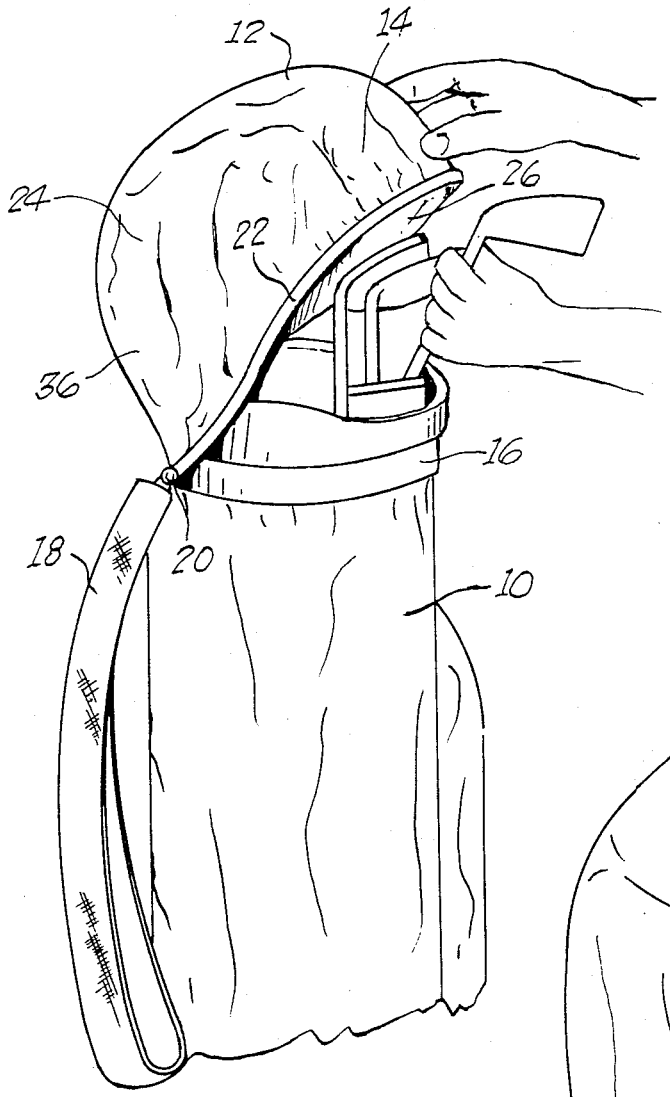
FIG. 1 shows the golf bag cover fitting over the clubs.

Referring now to FIG. 1, a golf bag 10 is shown having a golf bag cover 12 attached thereto. Cover 12 is shown in a position of being slightly removed from covering the club opening portion of bag 10 so that a club may be removed from bag 10. To fasten cover 12 to bag 10, one merely moves the front end 14 downward and over the lip 16 of bag 10.

Cover 12 may be attached to bag 10 by being attached to the shoulder strap area, such as either the shoulder strap 18 or shoulder strap buckle 20. Connected in this manner cover 12 may rotate about either shoulder strap 18 or buckle 20 downward over lip 16.

Cover 12 may be fabricated to include an elastic strip 22 at the bottom thereof so that it may be securely fastened over lip 16. The exact circumferential size of elastic strip 22 should be less than the circumference of lip 16 so that cover 12 fits snuggly over bag 10.

Cover 12, on the outer surface 24, should be a water repellant material such as plastic. The inner surface 26 of cover 12 should be a towel type material, such as terry cloth. The two materials may be fastened together by glue or other known fastening agents or a single material may be utilized in which inner surface 26 is relatively smooth and coated with a water repellant chemical.

Figure 2:
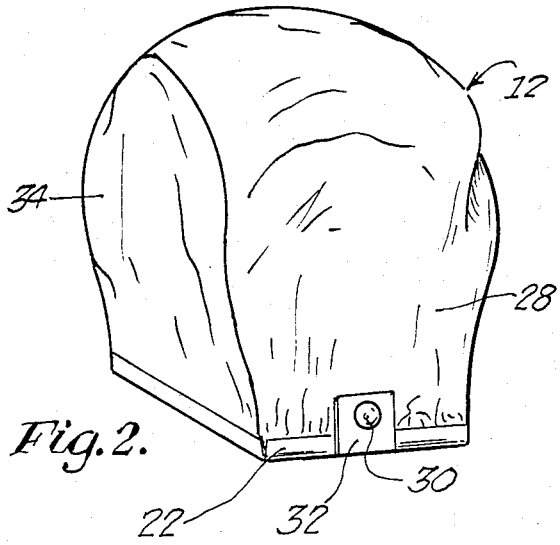
FIG. 2 shows the golf bag cover alone.

Referring now to FIG. 2, the opposite side of cover 12 is shown. On the back end 28 of cover 12, a grommet 30 is positioned near the lower center within a reinforcement material area 32. Grommet 30 should be of sufficient size to allow a spring clip to fit therethrough which can attach to either shoulder strap 18 or shoulder strap buckle 20. The clip of strap 18 may also be inserted through grommet 30.

Cover 12 may be fabricated by having two side pieces 34 and 36 cut to approximately the same size and a single piece consisting of front end 14 and back end 28. The three pieces should be sewn together in a configuration such as shown in FIG. 2. Elastic strip 22 may be added to the open bottom of cover 12. Lastly, reinforcement 32 and grommet 30 are added by known techniques. The actual size of each of the three pieces of material will depend upon the size of the bag and the height the clubs extend out of the bag. Because golf bags come in different sizes and clubs in different lengths, it may be necessary to have several different sizes of cover 12 for different combinations of bags and clubs.

Figure 3:
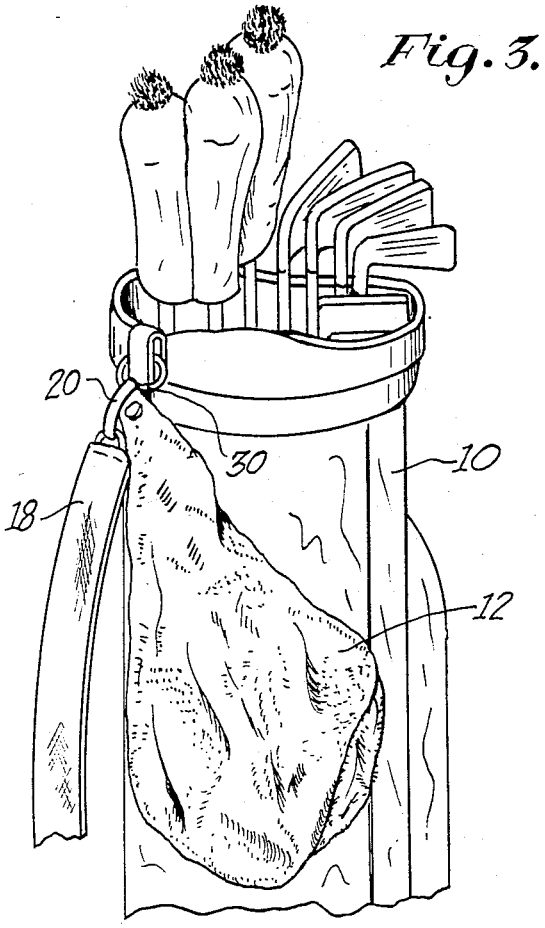
FIG. 3 shows the golf bag cover inverted and attached to the golf bag for use as a towel.

Referring now to FIG. 3, cover 12 has been inverted. Since, as previously mentioned, the inner surface of cover 12 is a towel like surface, cover 12 now serves to function as a towel to allow the golfer to either wipe his hands or wipe his golf clubs or golf balls as desired. The spring clip of shoulder strap 18 is shown inserted through grommet 30.

Figure 4:
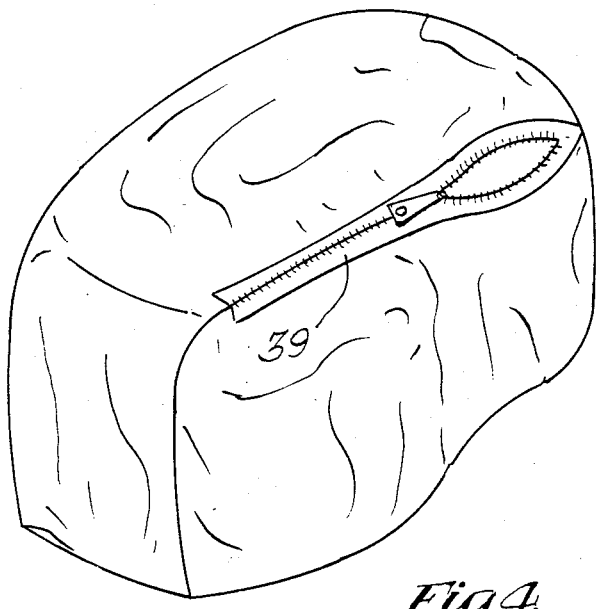
FIG. 4 shows another embodiment of golf bag cover.
Figure 5:
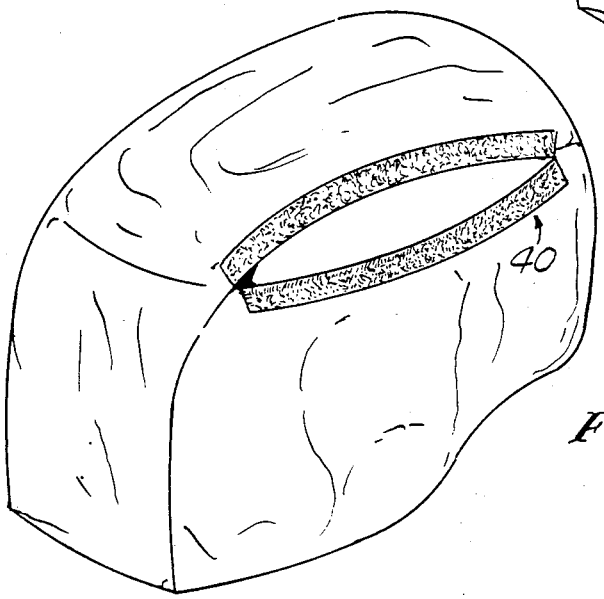
FIG. 5 shows a third embodiment of the golf bag cover.

Referring now to FIGS. 4 and 5 alternate embodiments of hood 12 are shown. Specifically in FIG. 4, a zipper 38 is added to one of the seams in cover 12. Zipper 38 provides the golfer with easy access to the clubs within golf bag 10 in the event he desires to keep them covered but still have access thereto. The addition of zipper 38 allows the golfer to avoid having to take the cover 12 on and off bag 10 in the manner shown in FIG. 1. In FIG. 5 zipper 38 is replaced by a pressure sensitive fastener 40. Fastener 40 may be made of a material such as Velcro or other type materials which adhere when pressed against each other. The purpose of pressure sensitive fastener 40 is the same as zipper 38.

Figure 6:
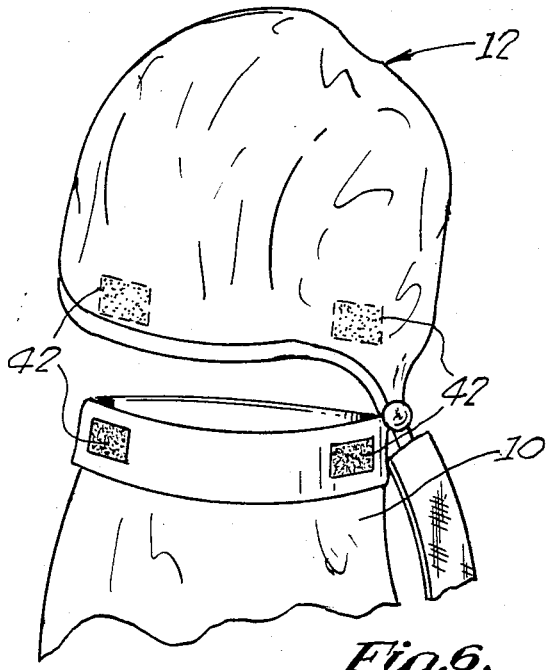
FIG. 6 shows another manner of attaching the golf bag cover to the golf bag.

Referring now to FIG. 6 rather than providing elastic strip 22 one could also use pressure sensitive fasteners 42 made of material such as Velcro for holding cover 12 on bag 10. This would require having fasteners 42 connected to both the bag and the inside of cover 12 around the periphery of both.

What I claim is:

1. A golf bag cover for being attached to a golf bag comprising:

a reversible hood having inner and outer surfaces, said inner surface being a towel material and said outer surface being a water repellant material;

means for attaching said hood to the shoulder strap area of said golf bag; and means for fastening said hood over said golf bag with said outer surface being exposed;

said hood being inverted when not fastened over said golf bag so that the exposed inner surface serves as a towel hanging from said shoulder strap area.

2. The invention according to claim 1 wherein said means for attaching includes a grommet.

3. The invention according to claim 1 wherein said means for fastening includes elastic within said hood, said elastic being sized to be expanded to fit over said golf bag.

4. The invention according to claim 3 wherein said means for attaching includes a grommet.

5. The invention according to claim 1 wherein said means for fastening includes fastener material affixed to the ends of said hood and to said golf bag for fastening the ends of said hood to said golf bag.

6. The invention according to claim 5 wherein said means for attaching includes a grommet.

7. The invention according to claim 1 wherein said hood includes openable access means for allowing access to golf clubs within said bag when said hood is fastened over said golf bag.

8. The invention according to claim 7 wherein said access means is a zipper.

9. The invention according to claim 7 wherein said access means includes fastener material.

10. The invention according to claim 7 wherein said means for attaching includes a grommet.

11. The invention according to claim 10 wherein said means for fastening includes fastener material affixed to the ends of said hood and to said golf bag for fastening the ends of said hood to said golf bag.

12. The invention according to claim 11 wherein said access means is a zipper.

13. The invention according to claim 12 wherein said access means includes fastener material.

* * * * *